US006695722B2

(12) United States Patent
Butler

(10) Patent No.: US 6,695,722 B2
(45) Date of Patent: Feb. 24, 2004

(54) OUTDOOR SPORTS GAME

(76) Inventor: Quincy Ann Butler, 2224 River Queen Dr., Violet, LA (US) 70092

( * ) Notice: Subject to any disclaimer, the term of this patent is extended or adjusted under 35 U.S.C. 154(b) by 0 days.

(21) Appl. No.: 09/894,715

(22) Filed: Jun. 28, 2001

(65) Prior Publication Data

US 2003/0004015 A1 Jan. 2, 2003

(51) Int. Cl.[7] ..... A63B 67/00
(52) U.S. Cl. ..... 473/415
(58) Field of Search ..... 473/415, 410; 273/298, 259

(56) References Cited

U.S. PATENT DOCUMENTS 2,533,904 A * 12/1950 Urban ..... 473/416
5,704,612 A * 1/1998 Kelly et al. ..... 273/402
5,735,749 A * 4/1998 Charbel et al. ..... 473/3
6,168,533 B1 * 1/2001 Camara ..... 473/3

OTHER PUBLICATIONS

Sylvia Worth, Rules of the Game,1995, St. Martin's Press, New York, New York,pp. 172–174.*

* cited by examiner

*Primary Examiner*—Paul T. Sewell
*Assistant Examiner*—M. Chambers

(57) ABSTRACT

A method of playing a ball game involving three players. The equipment consists of 2 bases, 6 cans, a ball and a bat. The players attempt to score points by hitting the cans with the ball or touching each of the bases while the pitcher is retrieving the ball.

1 Claim, 3 Drawing Sheets

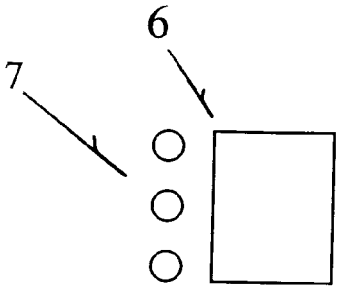
Fig 2
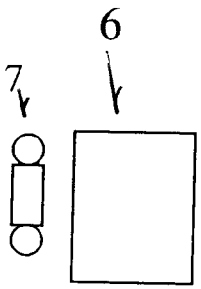
Fig 3
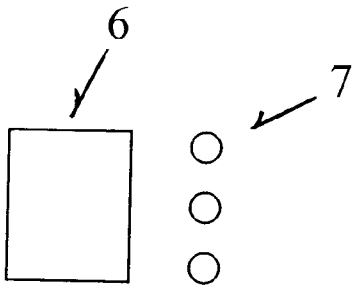
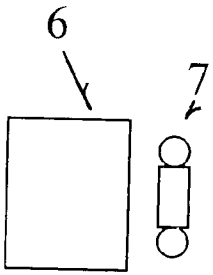

OUTDOOR SPORTS GAME

BRIEF SUMMARY

This invention relates to a novel ball game involving a of ball, 2 bases, 6 cans, a bat and a ball whereby recreation and exercise may be provided to 3 players. The players follow the stated rules of play to obtain points. Once each player has batted, the player with the highest score is declared the winner.

1. Prior art

Within applicant's knowledge there are no known references.

BRIEF SUMMARY OF THE INVENTION

The nature and substance of the invention is believed to be set forth in the foregoing with particular reference to the Abstract.

The primary object is to provide a ball game and apparatus therefor involving three players, requiring a limited playing area as compared to, say, a soft ball diamond, and in which the equipment may be said to be inexpensive for the number of players participating.

Another object is to provide simple and inexpensive equipment which is quickly and easily set up for playing the game and which is easily removed by placing in a container, e.g., a canvas bag, for storage or carrying.

The invention in the foregoing aspects and in other advantageous, related, or subsidiary aspects will be fully apprehended from the following detailed description of preferred embodiments taken in conjunction with the appended drawings:

DRAWING DESCRIPTION

BRIEF DESCRIPTION OF THE SEVERAL VIEWS OF THE DRAWING

FIG. 2 is a schematic view of the game layout showing equipment positions.

FIG. 3 is a schematic view of an alternate layout for the equipment.

Similar reference numerals are applied to similar elements throughout the drawing.

DETAILED DESCRIPTION

Figure 1:
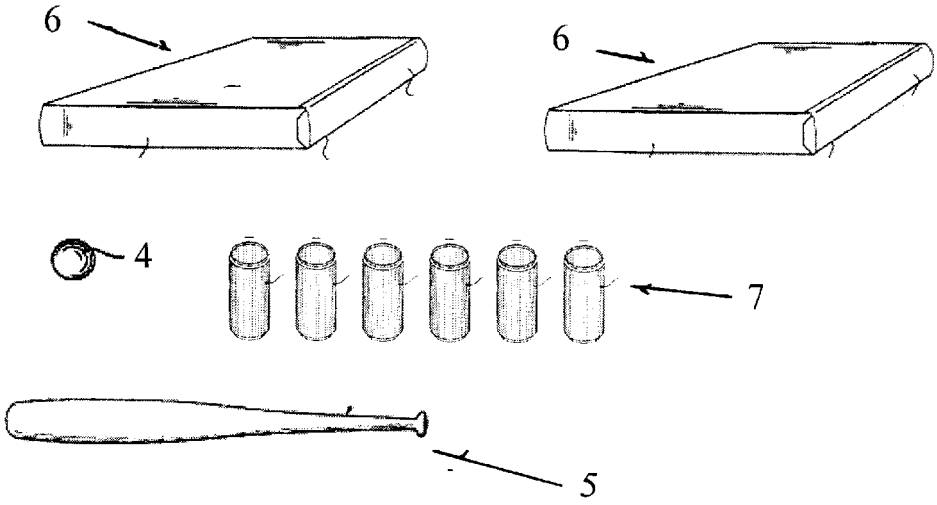
FIG. 1 is a representative view of the equipment used in the game, a bat, a ball, two bases and six cans.
Figure 4:
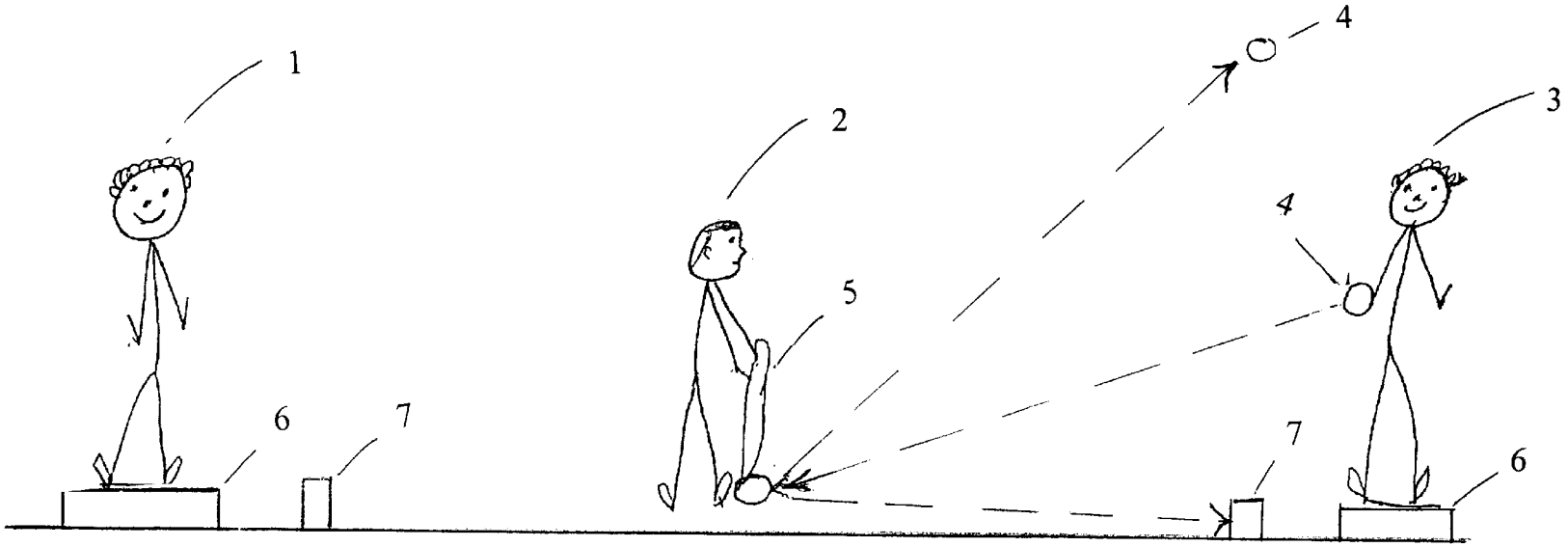
FIG. 4 is a schematic view of the game showing player positions and equipment during play.

Referring now to the drawings, and more particularly to FIG. 4, the numeral 8 generally indicates the Coon Cans game (the name being one coined by the applicant). The game equipment consists of two bases, 6 cans, a bat and a ball. The material and structure for these items are well known in the sporting art and do not need to be explained further. The title of this game is "Coon Cans". The method of playing the game of "Coon Cans" is detailed below.

1) The game can be played in any type of an open playing area such as a ball field.

2) The bases (6) are placed on the playing field with distance of 25–30 feet between the bases (FIG. 2).

3) Three cans (7) are placed approximately one foot in front of each base (FIG. 2).

4) The third can could also be placed horizontally placed on top of the two cans as an alternative embodiment (FIG. 3)

5) The three players initially choose their starting positions in any well know method of choosing playing positions. Since the players rotate, this is not a critical feature of the game.

It will be readily recognized by those skilled and unskilled in the art that the materials and dimensions above described are not critical and that these may be changed as desired or as expediency may dictate.

The equipment having been described above the playing of the game, as presently contemplated, will be described. It may be noted that prototypes of the apparatus have been built and the game tested.

The game consists of 3 sets of play. A set consists of a batter (2) playing until the batter (2) or the pitcher (3) knocks down the cans (7) with the ball (4) or has hit the ball with the bat (5) three times without scoring. At the end of the set, the pitcher (3) rotates to the catcher's position (1) and the batter (2) rotates to the pitcher's position (3) and the catcher (1) rotates to the batter's position (2). The method of rotation is not a critical feature of the game but should be consistent during the game. For example the batter could also rotate to the catcher's position which would have the catcher rotate to the pitcher's position. At the end of three sets, the game is over and the player who has acquired the most points wins the game. Once the game is over, the original players can start a new game or they can rotate into play new players and retire the current players.

The method of play is as follows:

An imaginary diagonal line of play connects the two bases. The batter (2) stands on the line between the pitcher (3) and the catcher (1).

A) A pitcher, batter and catcher takes their respective places on the playing field (FIG. 4).

B) The pitcher (3) and catcher (1) act as a team and the batter (2) acts alone.

C) The pitcher (3) and catcher (1) stand on their respective bases (6) with the cans (7) positioned in front of each base.

D) The batter (2) positions himself anywhere along the diagonal line of play. The batter (2) must be at least 3 feet in front of either set of cans (7) with the bat (5) positioned downwards.

E) The pitcher (2) rolls/throws the ball (4) at the catcher's cans(7).

If the ball hits the catcher's cans and knocks down at least one can, the pitcher gets a point if he yells "Coon Cans". If he fails to say this phrase, before the ball is returned to him, no points are awarded.

F) The batter (2) attempts to hit the ball (4) toward the pitcher's cans (7). If he knocks down any of the pitcher's cans, he must shout "Coon Cans". The batter (2) earns 10 points for this procedure. If the ball (4) is returned to the pitcher (3) and the pitcher re-positions the cans (7) before the batter (2) shouts "Coon Cans", no points are awarded to the batter (2).

G) If the struck ball (4) fails to knock over any of the cans (7), the pitcher (3) must retrieve the ball(4). While the pitcher (3) is retrieving the ball (4), the batter (2) has the opportunity to earn up to 2 points.

H) The batter (2) must run and touch the pitcher's base(6). No points are awarded for this action. If the batter (2) chooses to stay on the pitcher's base (6), he must shout "Coon Cans" and wait for the pitcher (3) to return with the ball (4). If the batter (2) does this for three consecutive pitches, the set is over and the players rotate positions.

I) If the pitcher (3) is still retrieving the ball (4), the batter (2) can run to the catcher's base (6) and get 1 point for touching the catcher's base (6). An additional point can be earned if the batter (2) runs from the catcher's base (6) to the pitcher's base (6) for a second time. This additional run earns the batter an additional point.

J) Once the pitcher (3) has retrieved the ball (4), the ball (4) can be thrown to the catcher (1) or kept by the pitcher (3). If the player holding the ball (4) knocks down either the catcher's or pitcher's cans (7), and yells "Coon Cans", before the batter touches the pitcher's base (6) for a second time, the batter (2) does not receive a point for that run.

K) If the pitcher (3) retrieves the hit ball (4) and knocks down one or more of the catcher's or pitcher's cans (7) and yells "Coon Cans" before the batter can reach the pitcher's base, no points are awarded to the batter.

L) If the batter (2) hits a ball (4) into the air and the pitcher (3) catches the ball (4) before it touches the ground, the pitcher (3) can say "Coon Cans", walk to the pitcher's cans (7) and knock them over.

M) The players rotate after each ball is played.

N) The game is played until one of the players has a score of 10 points or greater.

O) The ball is considered in play until the person holding the ball shouts "Coon Cans". At that point, the points are added to each player's respective totals and the players rotate.

The above description of the playing of the game is exemplary and is not to be considered as limiting since simple rule changes may be made within the spirit of the game disclosed.

While for purposes of description I have shown and described specific embodiments of my invention, and the way to play the game, it will be apparent that changes and modifications can be made therein without departing from the spirit of my invention or the scope of the appended claims.

What is claimed as new and desired to be protected by Letters Patent is set forth in the appended claims:

1. A sports team method of play, comprising:

a) selecting three players to play the game, b) positioning the articles of the game which include two bases, six cans, a ball and a bat c) selecting a position for each of the players as the pitcher, batter and catcher, d) having the pitcher attempt to knock down the catcher's cans with a ball, e) having the batter attempt to hit the ball and knock down the pitcher's cans, f) having the pitcher retrieve the ball after the batter hits the ball, g) letting the batter choose to perform one of the following while the pitcher is retrieving the hit ball, 1) run to the pitcher's base, 2) run to the pitchers base, then run to the catcher's base, 3) run to the pitcher's base, then run to the catcher's base and run back to the pitcher's base, h) assigning the following points to each player, 1) 10 points to the batter if the batter hits the pitcher's cans with the ball during play and shouts a specific word combination, 2) 1 point to the batter if the batter runs to the pitcher's base and then to the catcher's base after hitting the ball and shouts said specific word combination, 3) 1 additional point to the batter if the batter then runs to the pitcher's base and shouts said specific word combination, i) having the batter shout said specific word combination after hitting the ball, j) having the pitcher shout said specific word combination after retrieving the hit ball, k) having the pitcher shout said specific word combination if the pitcher catches the struck ball before it strikes the ground, l) rotating playing positions after each set of play, m) playing three sets of play game before totaling the score, and n) declaring a winner based on the total score of each player.

* * * * *